United States Patent [19]

Nakajima et al.

[11] Patent Number: 5,012,279

[45] Date of Patent: Apr. 30, 1991

[54] ABNORMALITY-DETECTING METHOD FOR AN ELECTROSTATIC IMAGE-RECORDING MACHINE

[75] Inventors: Yoshihiro Nakajima, Osaka; Akihiro Takada, Neyagawa, both of Japan

[73] Assignee: Mita Industrial Co., Ltd., Osaka, Japan

[21] Appl. No.: 365,617

[22] Filed: Jun. 14, 1989

[30] Foreign Application Priority Data

| | | | |
|---|---|---|---|
| Jun. 30, 1988 | [JP] | Japan | 63-163142 |
| Jun. 30, 1988 | [JP] | Japan | 63-163143 |
| Jun. 30, 1988 | [JP] | Japan | 63-163144 |
| Jun. 30, 1988 | [JP] | Japan | 63-163145 |
| Jun. 30, 1988 | [JP] | Japan | 63-163146 |

[51] Int. Cl.[5] ..... G03G 15/00; G03G 15/06; G03G 15/16; G03G 15/052

[52] U.S. Cl. ..... 355/205; 355/246; 355/77; 355/219; 355/271; 430/31

[58] Field of Search ..... 355/205, 208, 219, 221, 355/222, 225, 246, 77, 245, 271; 430/31, 937

[56] References Cited

U.S. PATENT DOCUMENTS

| | | | |
|---|---|---|---|
| 4,248,519 | 2/1981 | Urea | 355/208 X |
| 4,326,796 | 4/1982 | Champion et al. | 355/14 CH |
| 4,355,885 | 10/1982 | Nagashima | 355/208 |
| 4,511,240 | 4/1985 | Suzuki et al. | 355/246 |
| 4,806,980 | 2/1989 | Jamzadeh et al. | 355/208 |
| 4,860,048 | 8/1989 | Itoh et al. | 355/208 |

*Primary Examiner*—R. L. Moses

*Attorney, Agent, or Firm*—Beveridge, DeGrandi, & Wellacher

[57] ABSTRACT

An abnormality of a key component of an electrostatic image-recording machine is detected using a surface potentiometer originally installed in the machine for use in controlling the charging voltage of the photoreceptor drum. The detectable components are: main charger, transfer charger, discharge lamp, and developing roller. They are judged abnormal if the voltage of the drum surface is out of a normal range when they are functioned before an actual recording process (or during warming-up of the machine).

3 Claims, 13 Drawing Sheets

ABNORMALITY-DETECTING METHOD FOR AN ELECTROSTATIC IMAGE-RECORDING MACHINE

BACKGROUND

The present invention relates to a common method of detecting abnormalities of various key components of an electrostatic image-recording machine (e.g., a copying machine, a printer, etc.) and to an image-recording machine equipped with such abnormality-detecting function.

First, structure and operation of a typical conventional electrostatic copying machine are explained referring to FIG. 13 for easier understanding of the background of the present invention. The copying machine includes a reading part and a recording part within a body frame 129.

The recording part of the copying machine includes a main charger 102, a developing section 106, image-transferring section 107, separating section 108, drum-cleaning section 110 and discharging section 111, all of which are arranged around a photoreceptor drum 101 in the order of its rotation. Between the main charger 102 and the developing section 106 is arranged a space for an exposure section 103.

The drum 101 is a cylindrical body (usually made of aluminum or aluminum-alloy) coated on its surface with a photosensitive compound (e.g. vapor-deposited selenic compound). The main charger 102 is composed substantially of a charging wire **102*b* (usually made of tungsten) strained parallel to the drum axis and very close to the drum surface, and a case 102*a* covering the charging wire 102*b* at the back along the length. The charging wire 102*b* is applied a high voltage of 5–6kV to give the drum surface (photosensitive layer) a static potential of 600–800 V. The developing section 106 includes a toner hopper 112, regulator roller 113, mixing roller 114 and a developing roller 115. The image-transferring section 107 and the separating section 108 have almost the same structure as the main charger 102. The drum-cleaning section 110 includes a rubber blade 117 to wipe off toner powder on the drum surface, and the discharging section 111 includes a discharge lamp 118** whose irradiation discharges the photosensitive layer of the drum surface.

The reading part of the copying machine includes a moving optical system 128 which includes two independently movable units: an illumination unit 119 and a mirror unit 125. The illumination unit 119 is composed of an exposure lamp 120, elliptic reflector 121, auxiliary reflector 122 and a first reflector mirror 123. A slit 133 is formed between the elliptic reflector 121 and the auxiliary reflector 122. The mirror unit 125 is composed of a second reflector mirror 126 and a third reflector mirror 127.

Copying process by this copying machine is briefly explained. When an original 124 is placed on a glass plate 130 at the top of the body frame 129, pressed by a cover plate 131 with a buffer sponge 132 and the operator presses the copy-start switch, the illumination unit 119 runs from left to right along the glass plate 130 at a constant speed V, and the mirror unit 125 follows the illumination unit at half the speed V/2. The light of the lamp 120 is reflected by the original 124 and passes through the slit 133. The slitted light is reflected by the first, second and third mirrors 123, 126 and 127, passes through a fixed lens 134 and is further reflected by a fourth reflector mirror 135 to be brought to the exposure section 103 of the drum 101.

Since the mirror unit 125 runs at half speed of the illumination unit 119, the length of the light path from the surface of the original 124 to the surface of the drum 101 is kept constant throughout the reading process.

When the operator presses the copy-start switch, the recording part is also activated. The drum 101 starts rotating at a constant speed clockwise in FIG. 13, and the surface photosensitive layer of the drum 101 is charged at around 700 V by the main charger 102. The image of the original 124 is recorded at the exposure section 103 for producing a latent image on the charged photosensitive layer. Toner powder in a cassette 140 attached to the hopper 112 comes down through the regulator roller 113, and is mixed with carrier powder (usually iron powder) by the mixer roller 114. The developing roller 115 is charged at a predetermined bias voltage to attract the mixed powder around it, and only the toner is transferred from the developing roller 115 to the drum 101 by the voltage difference between them, by which the latent image is developed to a real image. The real image of toner is transferred onto a sheet of paper 142 which is supplied one by one by a pair of resist rollers 116 at the transferring section 107. The charging wire **108*b* of the separating section 108 applies alternating (AC) electrical field onto the drum 101 to separate the sheet 142 stuck to the drum 101 by electro-static force. Thus the copy of the original 124** is obtained.

After the sheet 142 is separated, the toner remaining on the drum surface is wiped off by the rubber blade 117 of the cleaning section 110, and the photosensitive layer of the drum 101 is discharged at the discharging section 111 by the discharge lamp 118.

The whole electrical system of the copying machine is controlled by a central processing unit (CPU) (not shown in FIG. 13) which uses a micro-computer.

The image-recording machine has some key components, and it is important for normal use of the machine to detect abnormalities of such key components.

One of the key components is the charging wire **102*b*, 107*b* or 108*b***. Since it has a very high voltage potential when activated, it tends to collect environmental dusts. Therefore, cleaning of the charging wire is necessary from time to time. Conventionally, such wire cleaning is performed when the operator notices it from the quality of the copy image, which is awkward and sometimes too late to maintain good copying quality.

The charging wire is applied such high voltage by a high voltage unit (HVU). The failure of the charging wire (e.g., brake or short circuit of the wire) or of the HVU is detected by a specially provided circuit in the HVU and is informed to the CPU of the image-recording machine by an appropriate alarm signal line. This requires the additional detecting circuit in the HVU and additional signal line between the HVU and the CPU, both increasing the cost of the machine and decreasing the reliability of the electrical system.

The charging wire **108*b* of the separating section 108 is different among the three wires because it is applied an alternating voltage (AC voltage) to separate the sheet 142 statically attached to the drum 101. Precisely saying, the AC voltage (normally +/−5 kV) of the separating wire 108*b* is biased by a small amount ("shift-bias", about 0.1 kV) to compensate for the tendency of the photosensitive layer of the drum 101** to shift to negative charging.

Another key component is the discharge lamp 111. Insufficient discharging of the drum 101 caused by deposition of toner powder on the lamp surface, or failure of discharging due to malfunction of the lamp 111, will lead to an accumulated pile-up of charge on it, which results in foggy background of the recorded image.

These abnormalities of the discharge lamp 111 is conventionally detected by the devices as shown in FIGS. 14A and 14B. In the device of FIG. 14A, the current to the discharge lamp 111 is allowed or stopped by the CPU 150 using a switching triac 154, and when the current flows, it is monitored by the CPU 150 using a photocoupler 152. When the amount of current falls below a certain level, the discharge lamp 111 is judged abnormal. In FIG. 14B, the light from the lamp 111 is directly sensed by a photosensor 156. In any case, the detecting device require an additional component (photocoupler 152 or a photosensor 156) which increases the cost of the machine.

Still another key component is the developing roller 115. The bias voltage for the developing roller 115 must be strictly controlled to obtain a clear toner image on the drum 101 because, as explained before, the voltage difference between the roller 115 and the drum 101 determines the amount of toner transferred.

Conventional abnormality detecting method for this bias voltage for the developing roller 115 is the same as that for the charging wires; i.e., to provide an abnormality detecting circuit in a controller for giving the bias, and the abnormality signal is sent to the CPU using an appropriate alarm-signal line provided besides the control-signal line between the CPU and the bias controller.

SUMMARY OF THE INVENTION

An object of the present invention is, therefore, to provide a common abnormality detecting method for those key components of the photostatic image-recording machine. The abnormalities includes those of: the chargers for the main charger, transfer charger and AC charger; the discharge lamp; and the developing roller. In the present invention, all those abnormalities are detected by using a surface potentiometer which is provided in conventional photostatic image-recording machines to regulate the charging voltage of the photoreceptor drum. After proper charging, discharging or toner transferring is preformed, the surface potentiometer is used to detect the surface voltage of the drum. When the detected surface voltage is out of the normal range that is predetermined for those normally working components, the pertinent component is judged abnormal. Detailed processes for individual components are described in the embodiments that follow.

BRIEF EXPLANATION OF THE ATTACHED DRAWINGS

DETAILED DESCRIPTION OF PREFERRED EMBODIMENTS

Embodiments of the present invention are described separately with respect to abnormalities and components.

Detection of Abnormality of the Main Charger and Transfer Charger (Embodiment 1)

Figure 1:
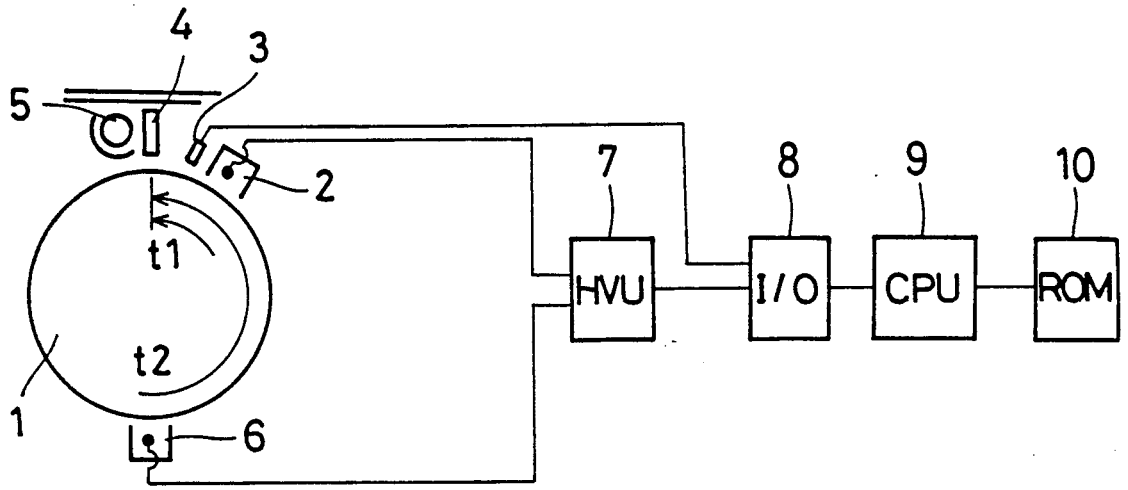
FIG. 1 is a schematic diagram of a copying machine according to the first embodiment.
Figure 13:
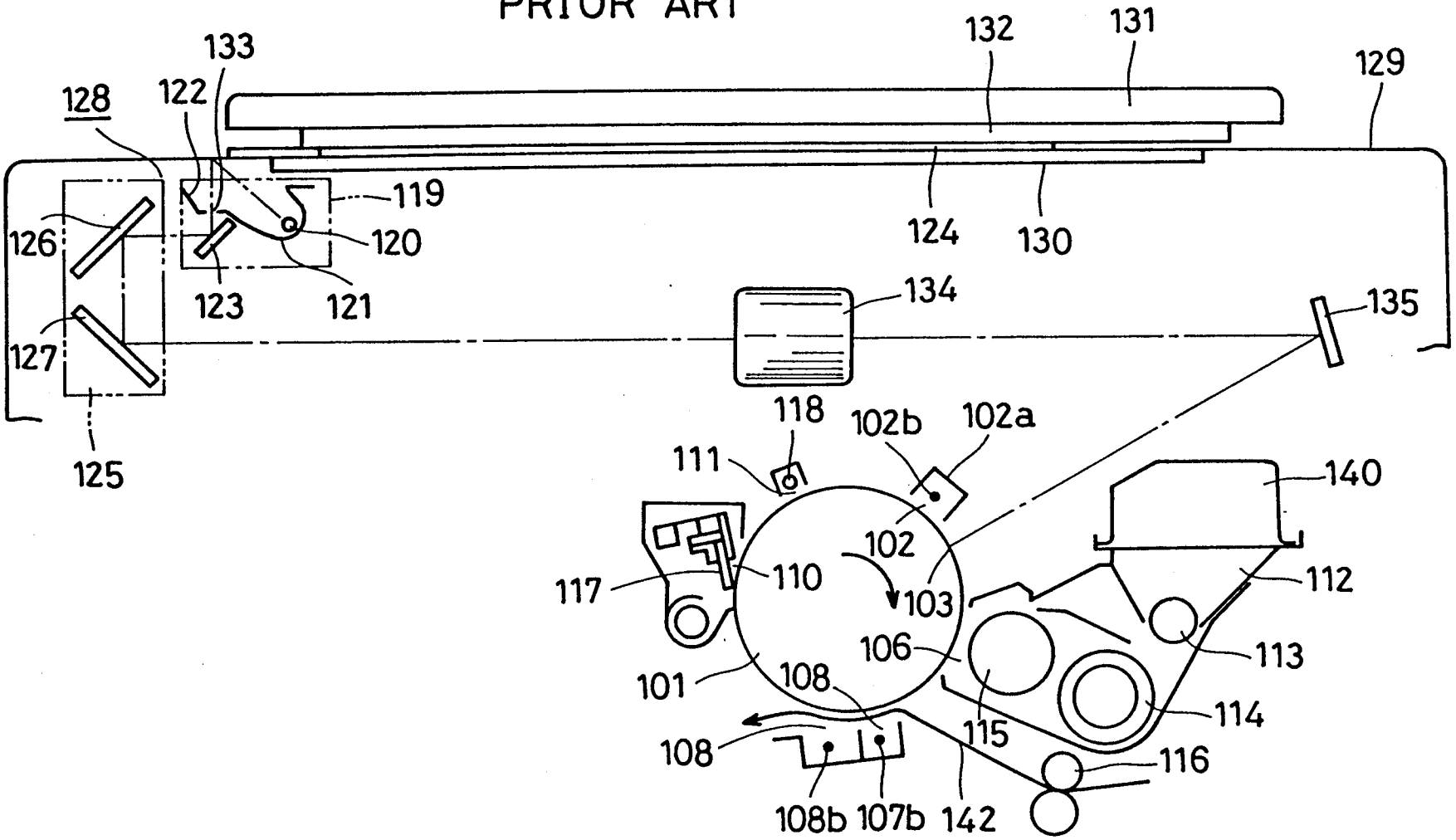
Fig. 13 PRIOR ART
FIG. 13 is a schematic diagram of a conventional copying machine.
Figure 14A:
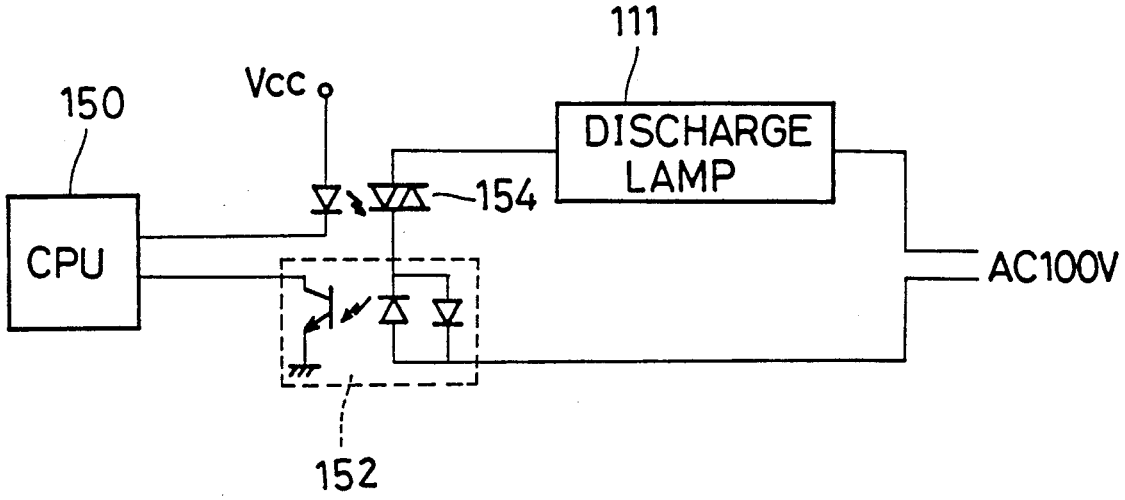
Fig. 14A PRIOR ART
FIGS. 14A and 14B are circuit diagrams for detecting an abnormality of a discharge lamp according to the prior art.
Figure 14B:
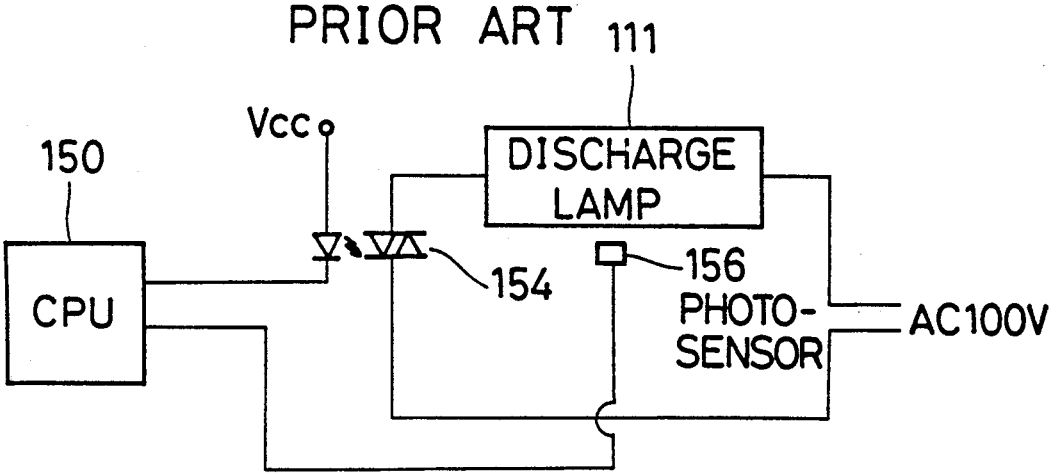
Fig. 14B PRIOR ART

FIG. 1 shows the basic components of an electrostatic copying machine that relate to the this embodiment. It should be noticed that the rotating direction of the drum 1 is opposite to that in FIG. 13, and therefore the arrangement order of the components around the drum 1 is reversely drawn. Drawn in FIG. 1 are: the photoreceptor drum 1, the main charger 2, the transfer charger 6, the high voltage unit (HVU) 7 for the two chargers 2 and 6, input and output interface (I/O) 8, central processing unit (CPU) 9, and a read only memory (ROM) 10. Only for simplicity of explanation, the exposure section 4 located at the top includes, instead of moving optical system, static exposure lamp 5 and an optical path 4 composed of a linear array of Selfoc (trade name) lenses. In this case, the original set at the top moves.

A new component, surface potentiometer 3, is introduced in FIG. 1 between the main charger 2 and the exposure section 4. Originally, the potentiometer 3 is provided in the electrostatic copying machine for sensing the surface voltage of the drum 1 during copying in order to, in cooperation with the CPU 9, feedback-control the surface voltage. In this embodiment, however, the potentiometer 3 plays a key role in detecting the abnormalities (failure of the wire, failure of the HVU 7, or dust deposition on the wire) of the chargers 2 and 6.

The charging wires of chargers 2 and 6 are applied high voltage by the HVU 7, which is controlled by the CPU 9 through the I/O 8. The potentiometer 3 is also connected to the CPU 9 through the I/O 8 to give a signal to the CPU 9 representing detected surface voltage of the drum 1. The ROM 10 stores various control programs for the copying machine including the following abnormality-detecting programs that are described below and constants used in the programs.

Figure 2:
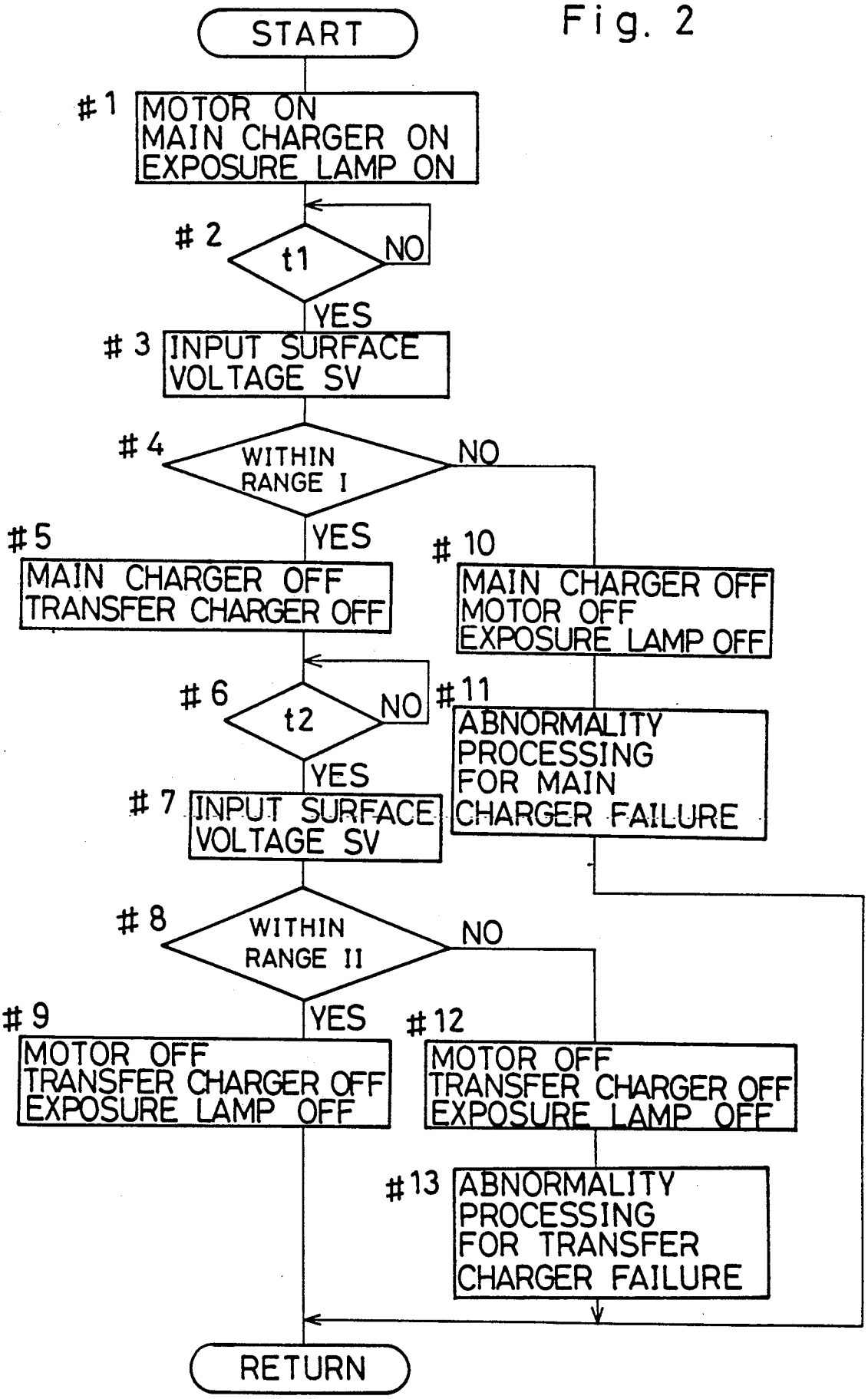
FIG. 2 is a flowchart according to the first embodiment.

The detecting process is executed by the CPU 9 using a program stored in the ROM 10, which is explained referring to the flowchart of FIG. 2. This process is executed before the actual copying operations (or during the warming-up period).

In the process, first the motor (not shown) for rotating the drum 1, the main charger 2 and the exposure lamp 5 are turned on at step #1. After waiting for t1 seconds at step #2, the CPU 9 inputs a signal from the surface potentiometer (SP) 3 representing the surface voltage of the drum 1 at step #3. The time t1 is determined as (actually, a little longer than) the time required for the drum 1 to rotate from the main charger 2 to the potentiometer 3. The sensed surface voltage value SV is compared at step #4 with the normal range I of the surface voltage read out from the ROM 10. The normal range I (e.g., 600–1000 V) is predetermined by a previous experiment. If the surface voltage of the drum 1 is below 600 V or over 1000 V, it is assumed something is wrong in the main charger 2 or in the HVU 7. In that case, the main charger 2, the motor and the exposure lamp 5 are all turned off at step #10, and an abnormality processing is executed at step #11 to cope with the failure or trouble of the main charger 2 or the HVU 7. For example, a warming lamp is turned on, or buzzer is beeped to inform the abnormality to the operator.

If the sensed voltage SV is within the normal range I ($600 \leqq SV \leqq 1000$), the CPU 9 then checks the transfer charger 6. Since the HVU 7 includes separate sub-units for the main charger 2 and the transfer charger 6, that part of the HVU 7 for the transfer charger 6 (and the charger 6 itself) can be checked here. After turning off the main charger 2 and turning on the transfer charger 6 at step #5, the CPU waits for t2 seconds at step #6 for the drum 1 to come from the transfer charger 6 to the potentiometer 3. Here, time t2 is also predetermined regarding the rotating speed of the drum 1 and the distance between the two components 6 and 3. After that, the CPU 9 inputs the surface voltage SV again at step #7, and compares the value SV with a normal range II stored in the ROM 10 (step #8), which is previously determined for the normal transfer charger 6. If the sensed value SV is out of the normal range II, steps #12 and #13 are executed similarly to the above explained steps #10 and #11 to cope with the abnormality of the transfer charger 6 or the HVU 7. If the sensed voltage SV is within the normal range II, the motor, the charger 6 and the exposure lamp 5 are turned off to end the checking process.

If dust deposition on the charging wires of the chargers 2 and 6 is to be checked, additional steps are inserted between the steps #4 and #5, and between the steps #8 and #9, respectively. In these additional steps, the sensed surface voltage SV is further compared with narrower reference ranges I′ and II′ which has higher lower-limit value. For example, in the case between steps #4 and #5, the reference range I′ is 700–1000 V. If the sensed voltage SV is determined out of the range I′, the voltage SV is between 600–700 V which means that the charging wire is unclean. In this case, another abnormality processing is executed to inform the operator the wire cleaning timing.

Detection of Failure of the Discharge Lamp (Embodiment 2)

Figure 3:
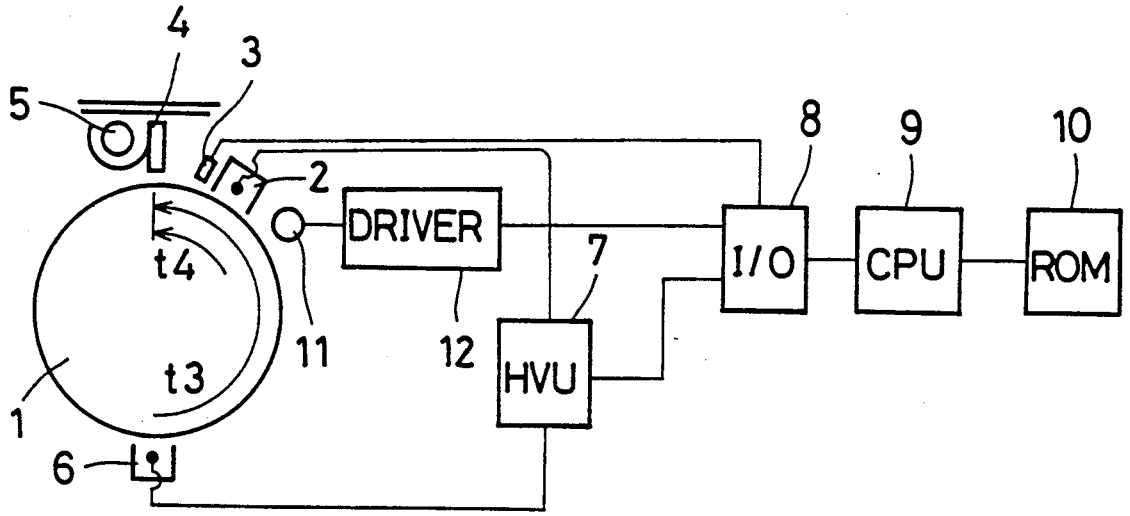
FIG. 3 is a schematic diagram of a copying machine according to the second embodiment.

FIG. 3 shows the basic components relating to the present embodiment, in which same numerals designate the same components as in FIG. 1. Newly included in FIG. 3 are: a discharge lamp 11 placed (with respect to the rotation of the drum 1) just before the main charger 2 and the potentiometer 3, and a driver circuit 12 for the discharge lamp 11 connected to the I/0 8.

Figure 4:
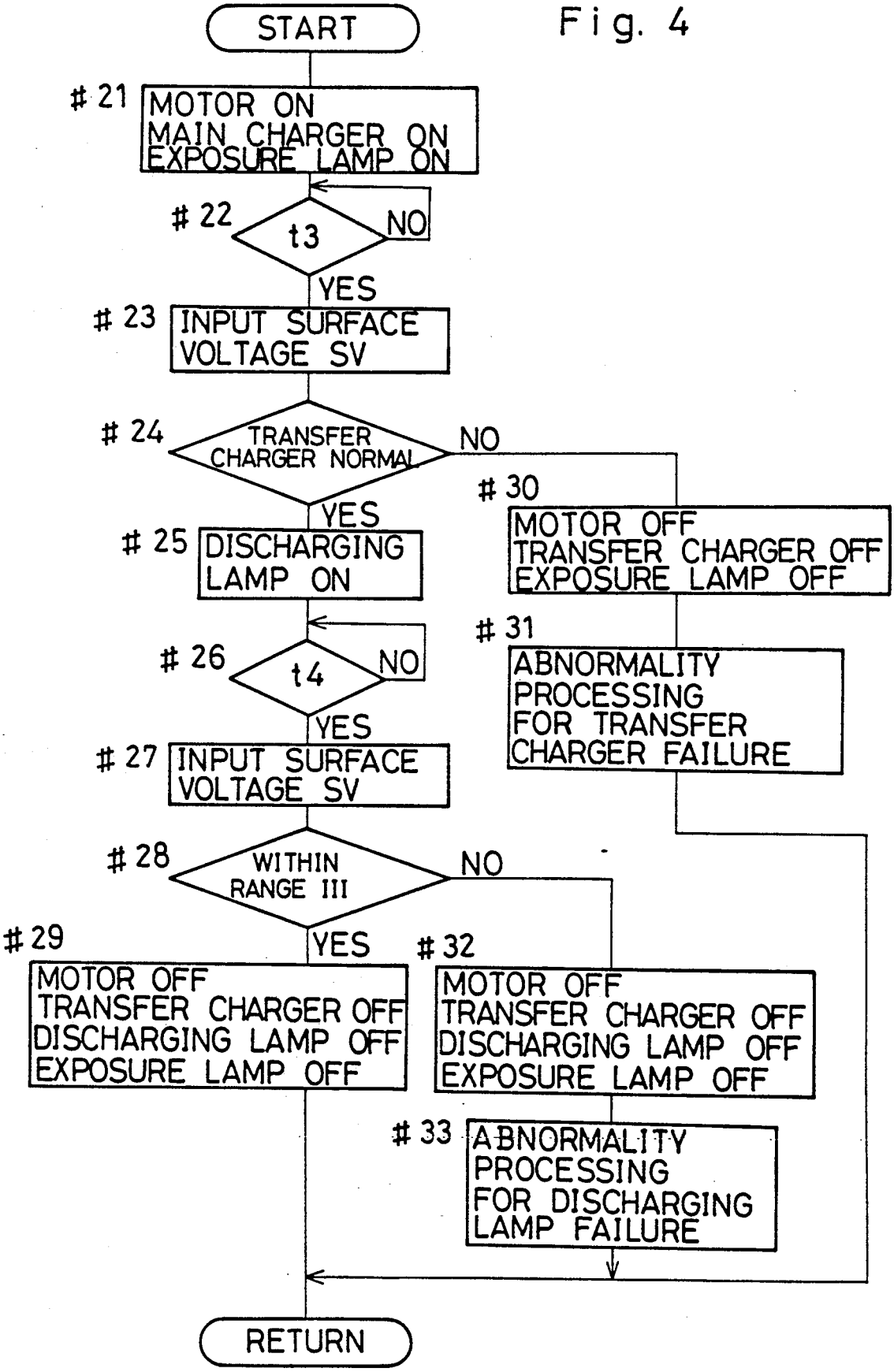
FIG. 4 is a flowchart according to the first embodiment.

The process is explained referring to the flowchart of FIG. 4. This process is also executed before the actual copying operation (or during the warming-up period).

In the process, first the motor, the transfer charger 6 and the exposure lamp 5 are turned on at step #21. After waiting for t3 seconds at step #22, the CPU 9 inputs the surface voltage signal SV at step #23. Here, time t3 is, as in the above embodiment, predetermined regarding the rotating speed of the drum 1 and the distance between the two components 6 and 3 (t3 may be equal to t2). The sensed surface voltage value SV is compared at step #24 with the normal range II′ to determine whether the transfer charger 6 is working normally. If the surface voltage of the drum 1 is out of the normal range II′, the transfer charger 6 is determined abnormal at step #30, and the transfer charger 6, the motor and the exposure lamp 5 are all turned off at step #31 because it is inappropriate to check the abnormality of the discharge lamp 11 when the charging is abnormal. In this case, an abnormality processing similar to step #13 in FIG. 1 is executed at step #31 to cope with the failure or trouble of the charger 6 or the HVU 7.

If the sensed voltage SV is within the normal range II′, the CPU 9 then checks the discharge lamp 11. After turning on the discharge lamp 11 at step #25, the CPU 9 waits for t4 seconds at step #26 for the drum 1 to come from the discharge lamp 11 to the potentiometer 3.

After that, the CPU 9 inputs the surface voltage SV again at step #27, and compares the value SV with a normal range III stored in the ROM 10 (step #28), which is previously predetermined for the normal surface voltage value after the drum surface is discharged by a normally working discharge lamp 11. If the sensed value SV is out of the normal range III, steps #32 and #33 are executed similarly to the steps #30 and #31 to cope with the abnormality of the discharge lamp 11. If the sensed voltage SV is within the normal range III, the motor, the transfer charger 6, the discharge lamp 11 and the exposure lamp 5 are turned off at step #29 to end the check process.

Detection of Uncleanness of the Discharge Lamp (Embodiment 3)

Figure 5:
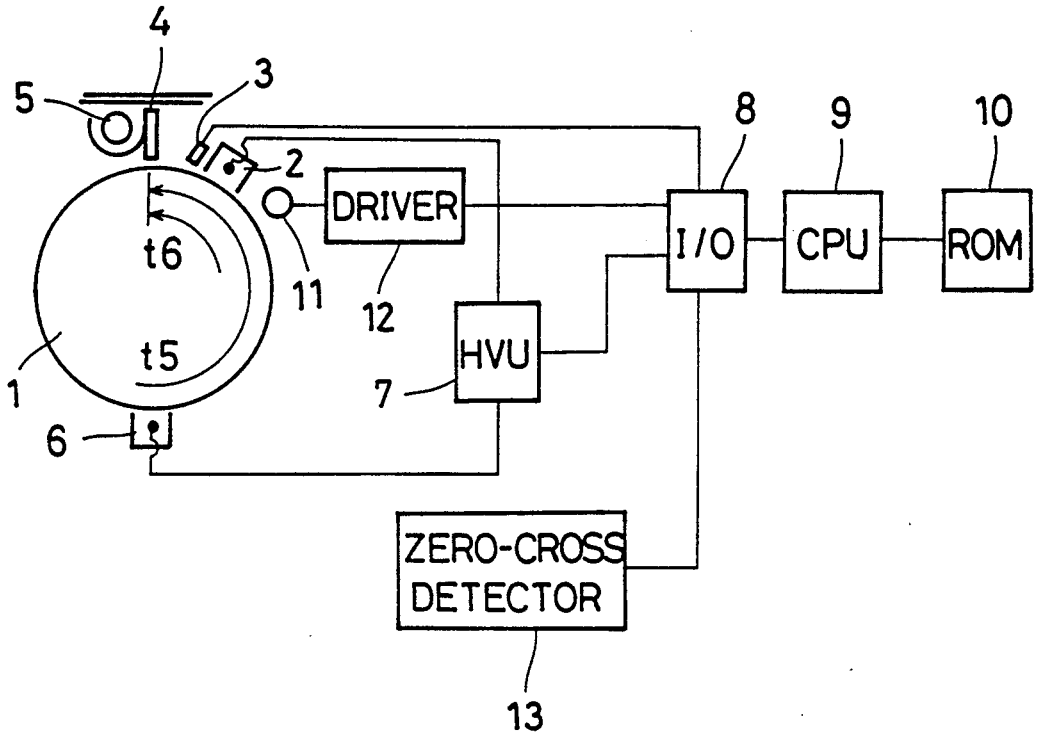
FIG. 5 is a schematic diagram of a copying machine according to the third embodiment.

FIG. 5 shows the basic components relating to the present embodiment, in which same numerals designate the same components as in FIG. 3. Newly included in FIG. 5 is a zero-cross-point detecting circuit 13 connected to the I/O 8. This circuit 13 detects the point of the source current (FIG. 6(*a*)) crossing the zero-current line, and outputs a pulse signal at that time (FIG. 6(*b*)). The CPU 9 receives this pulse through the I/O 8, and generates a control signal (FIG. 6(*c*)) whose duration is shorter than the cycle time of the source current (FIG. 6(*a*); in this case, the duration is half the cycle time). The discharge lamp 11 is given the source current only during the duration of the control signal, as in FIG. 6(*d*), and emits light at half the strength of normal operation. The strength ratio is of course set at any value.

Figure 7:
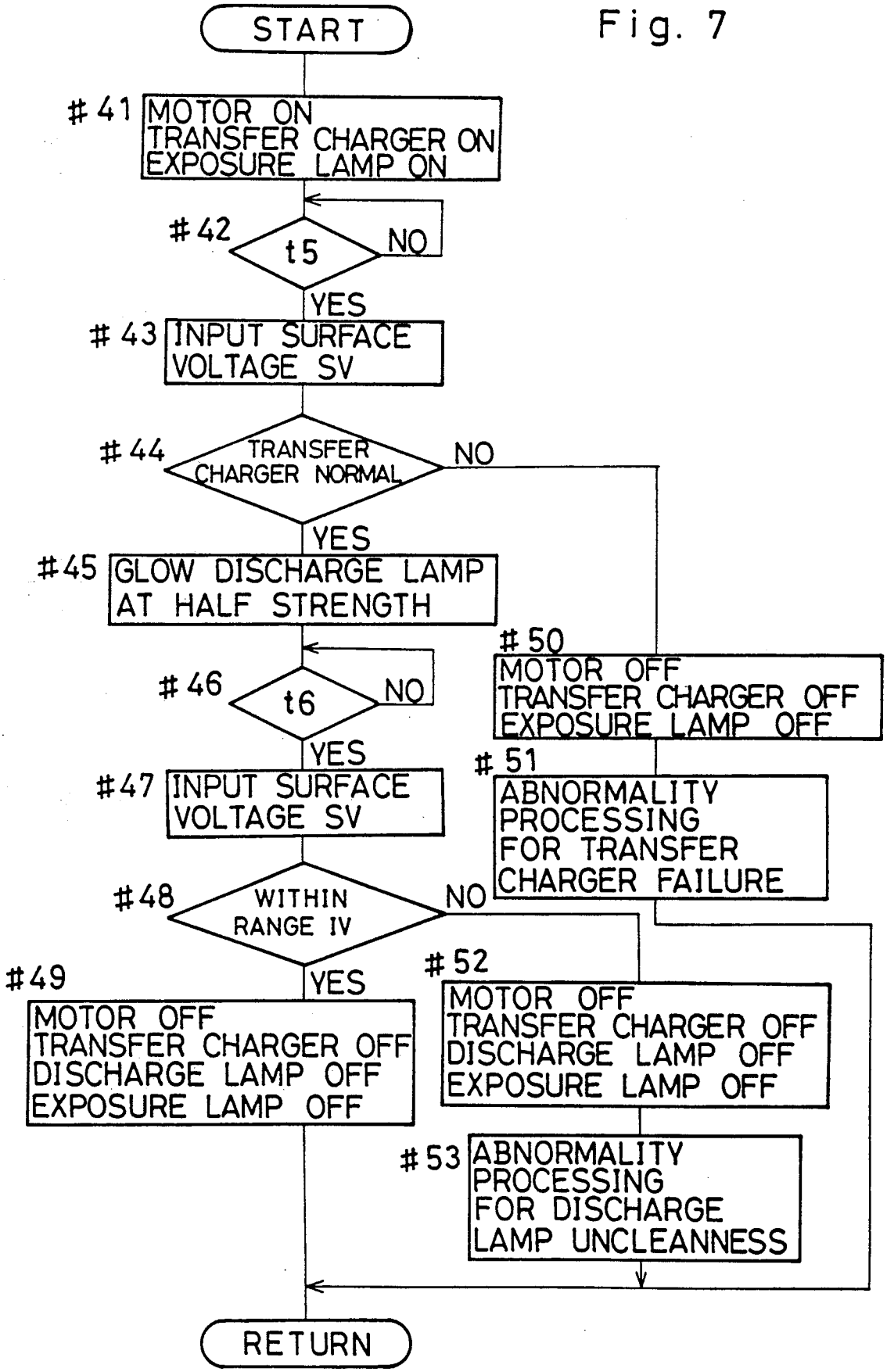
FIG. 7 is a flowchart according to the third embodiment.

The process is explained referring to the flowchart of FIg. 7. This process also is executed before the actual copying operation (or during the warming-up period).

In the process, first the motor, the transfer charger 6 and the exposure lamp 5 are turned on at step #41. After waiting for t5 (which may be equal to t3 or t2) seconds at step #42, the CPU 9 inputs the surface voltage signal SV from the potentiometer 3. The sensed surface voltage value SV is compared at step #44 with the normal range II' to determine whether the transfer charger 6 is working normally. If the surface voltage of the drum 1 is out of the normal range 11', the following process at steps #50 and #51 is the same as those at #30 and #31 of FIG. 4.

Figure 6:
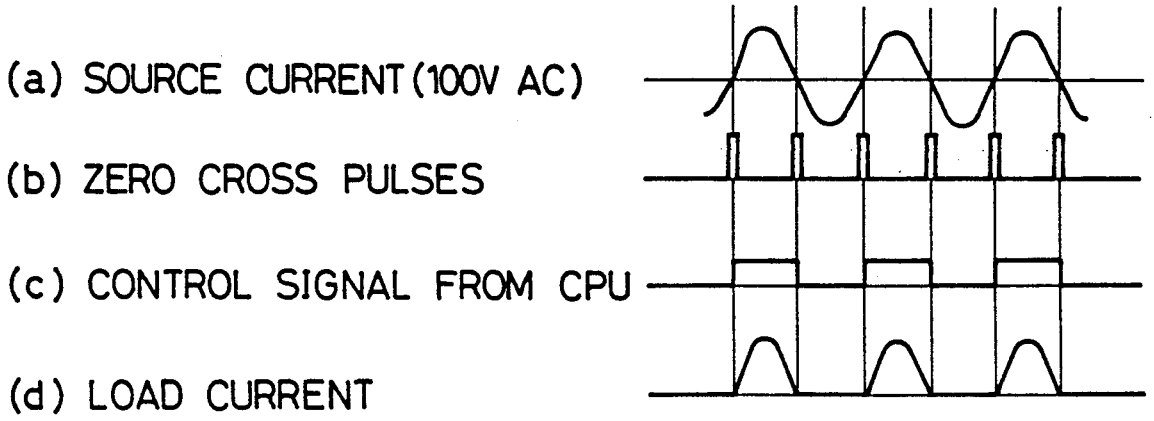
FIG. 6 shows the source current (a), zero-cross pulse signal (b), CPU control signal (c), and load current (d) of the discharge lamp.

If the second voltage SV is within the normal range 11', the CPU 9 then checks uncleanness of the discharge lamp 11. At step #45, the CPU 9 reduces the strength of the discharge lamp 11 using the above-described method. In this embodiment, the strength is, as shown in FIG. 6(*d*), half the normal value. The CPU 9 then waits for t6(=t4) seconds at step #46 for the drum 1 to come from the discharge lamp 11 to the potentiometer 3. After that, the CPU 9 inputs the surface volate SV again at step #47, and compares the value SV with another normal range IV stored in the ROM 10 (step #48), which is previously predetermined for the normal surface voltage value after the drum surface is discharged by a clean discharge lamp 11 with half the full light strength. The strength of the discharge lamp 11 is reduced in this checking process because feebler light is redused more and the detection becomes easier when the lamp 11 is unclean.

If the sensed value SV is out of the normal range IV, steps #52 and #53 are executed similarly to the steps #42 and #43 of FIG. 4 to cope with the abnormality of the discharge lamp 11. If the sensed voltage SV is within the normal range IV, the motor, the transfer charger 6, the discharge lamp 11 and the exposure lamp 5 are turned off at step #49 to end the check process.

Detection of Abnormality of the AC Charger (Embodiment 4)

Figure 8:
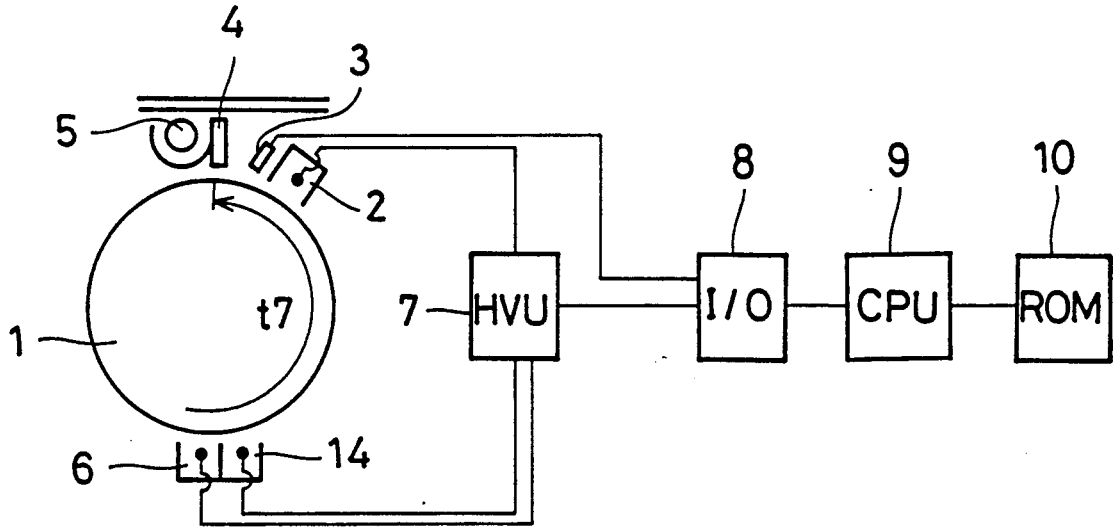
FIG. 8 is a schematic diagram of a copying machine according to the fourth embodiment.

FIG. 8 shows the basic components relating to the present embodiment, in which same numerals designate the same components as in FIG. 1. Newly included in FIG. 8 8 is the AC charger 14 used for separating a paper sheet from the drum 1, which is the subject of this embodiment. The AC charger 14 is placed adjacent to the transfer charger 6 downstream with respect to the rotation of the drum 1, and is supplied alternating (AC) high voltage with the shift-bias voltage from a subsection of the HVU 7.

Figure 9:
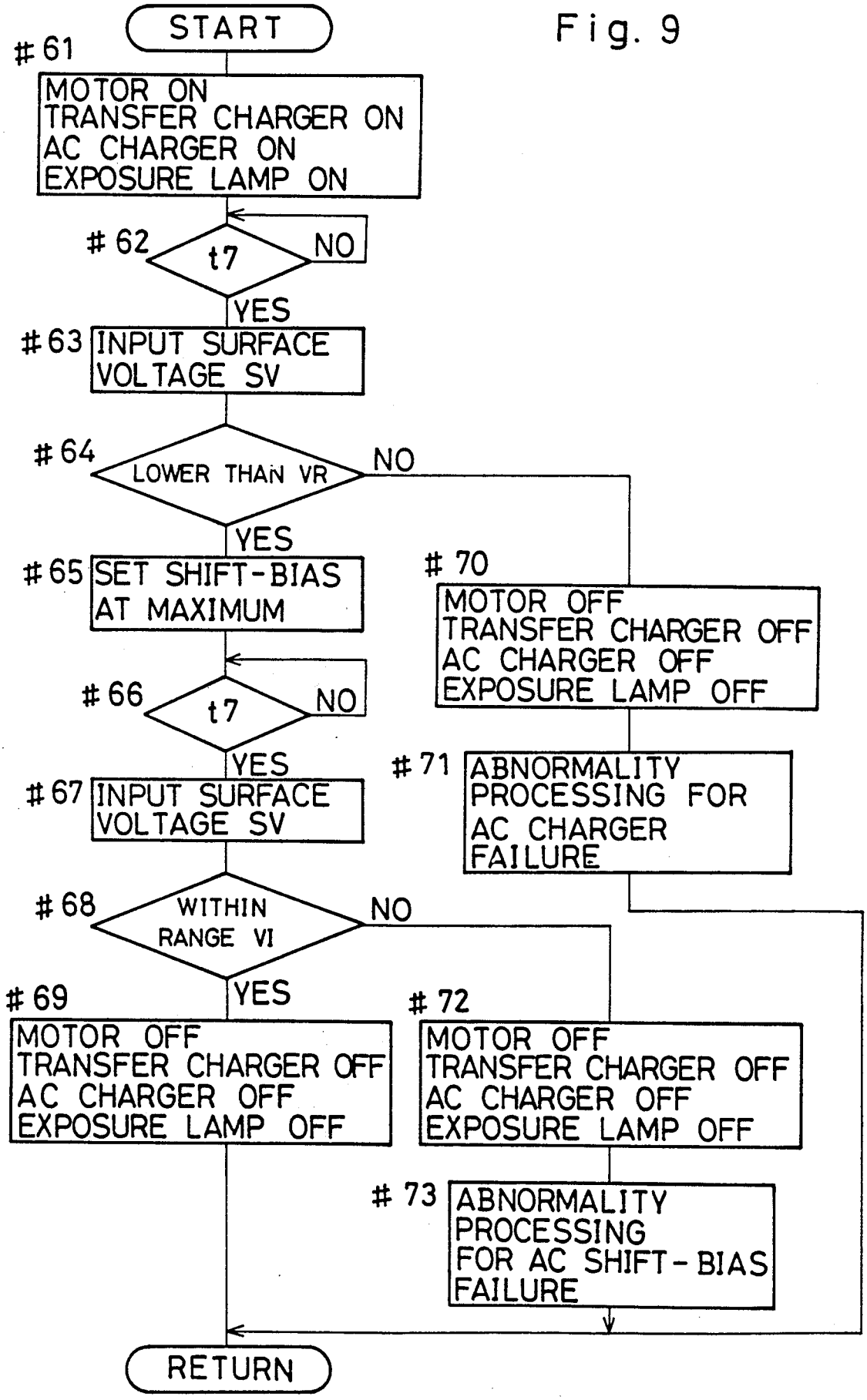
FIG. 9 is a flowchart according to the fourth embodiment.

The process is explained referring to the flowchart of FIG. 9. This process is also executed before the actual copying operation (or during the warming-up period).

In the process, first the motor, the transfer charger 6, the AC charger 14 and the exposure lamp 5 are turned on at step #61. After waiting for t7 (=t2) seconds at step #62, the CPU 9 inputs the surface voltage signal SV at step #63, which is compared at step #64 with a reference voltage value VR stored in the ROM 10 to determine whether the transfer charger 6 and the AC charger 14 are normal. The reference value VR is predetermined by a previous experiment for a surface voltage of the drum 1 when the photoreceptor is charged normally by the transfer charger 6 and then given an alternating electric field by the AC charger 14. The value VR is ordinarily set a 0 V, or slighly larger than 0 V. If the surface voltage of the drum 1 is higher than the reference value VR, it is assumed something is wrong in the AC charger 14 or in (that section of) the HVU 7. In this case, the motor, the transfer charger 6, the AC charger 14 and the exposure lamp 5 are all turned off at step #70, and an abnormality processing is executed at step #71 to cope with the failure to trouble of the AC charger 14 or the HVU 7 similarly to step #11 of FIG. 1.

If the surface voltage of the drum 1 is lower than the reference value VR, the CPU 9 then checks whether the shift-biasing circuit in the HVU 7 is normally working. The CPU 9 sets the shift-bias for the AC charger 14 at its maximum value at step #65. For example, the maximum shift-bias value is 500 V. After waiting for t7 seconds at step #66, the CPU 9 inputs the surface voltage SV again at step #67, and compares the value SV with a normal range VI stored in the ROM 10 (step #68). This range VI is previously determined as the surface voltage value when the photoreceptor is charged by a normal transfer charger 6 and then AC-charged by a normal AC charger 14 with the maximum shift-bias voltage (500 V). In determining the normal range VI, the amplitude of the AC voltage, the general characteristic of the photoreceptor (i.e., it tends to be charged negative by the corona-charging) are considered as well as the amount of shift-bias. If the sensed value SV is out of the normal range VI, steps #72 and #73 are executed similarly to the steps #60 and #61 to warn the operator of the abnormality of the shift-biasing circuit of the HVU 7. If the sensed voltage SV is within the normal range VI, the motor, the transfer charger 6, the AC charger 14 and the exposure lamp 5 are turned off at step #69 to end the check process.

Detection of Abnormality of the Bias Voltage for the Developing Roller (Embodiment 5)

Figure 10:
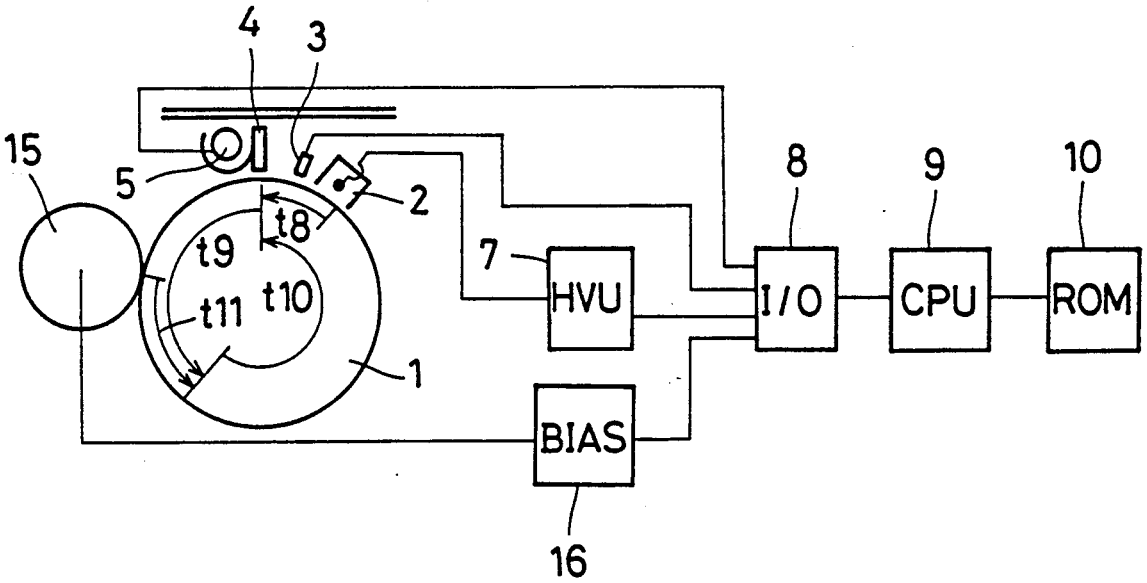
FIG. 10 is a schematic diagram of a copying machine according to the fifth embodiment.

FIG. 10 shows the basic components relating to the present embodiment, in which same numerals designate the same components as in FIG. 1. Added in FIG. 10 are: a developing roller 15 placed (with respect to the rotation of the drum 1) after the exposure section 4, and a biasing circuit 16 for the developing roller 15 connected to the I/O 8.

Figure 11:
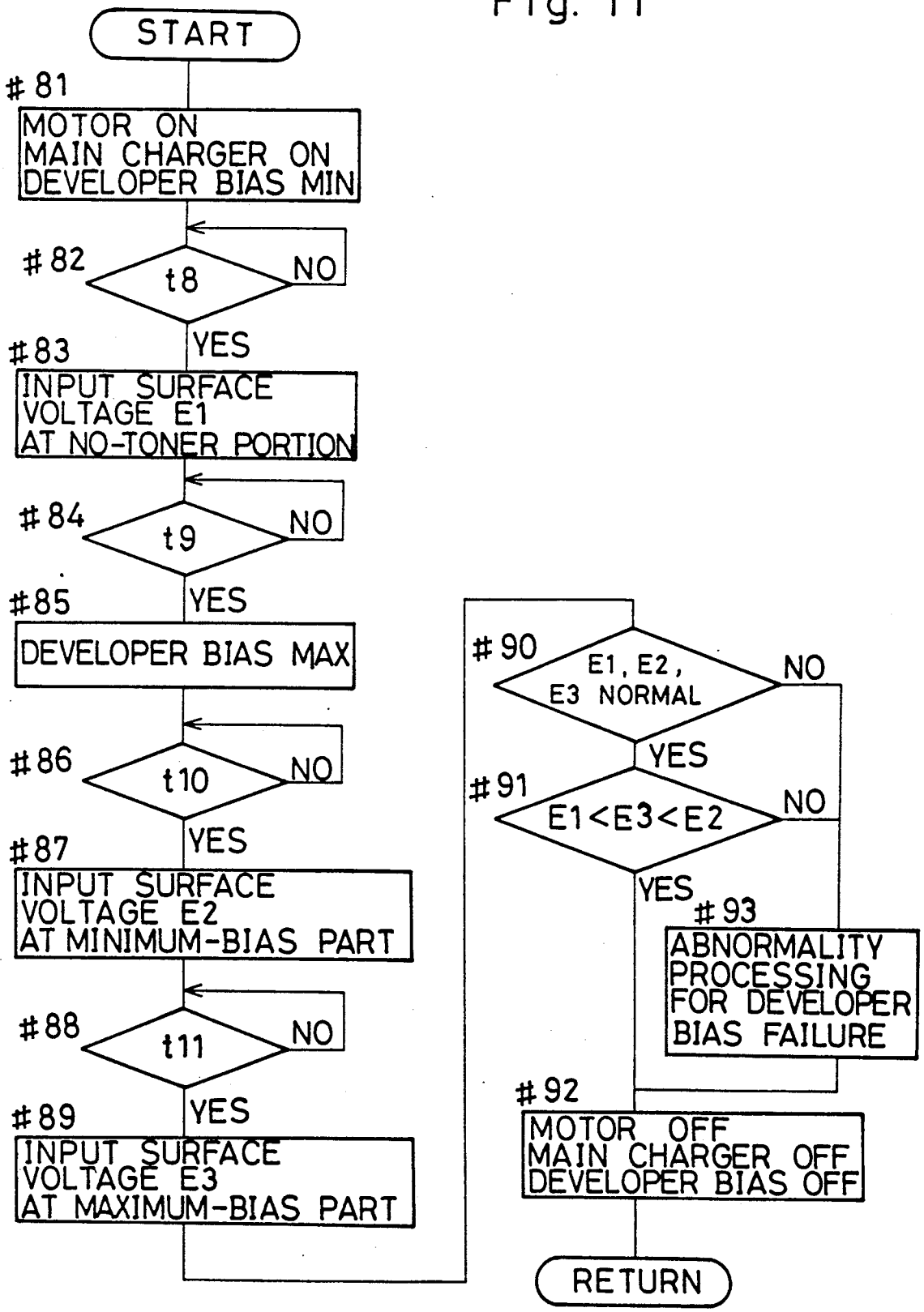
FIG. 11 is a flowchart according to the fifth embodiment.
Figure 12A:
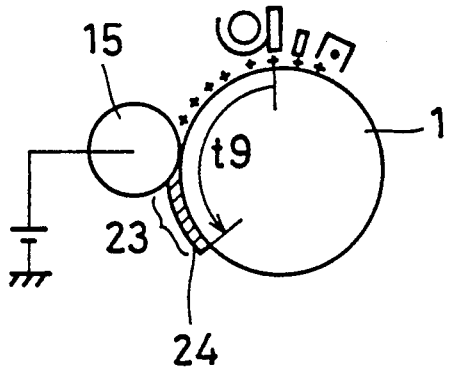
FIGS. 12A–12C are timing charts of toner transfer process in the fifth embodiment.
Figure 12B:
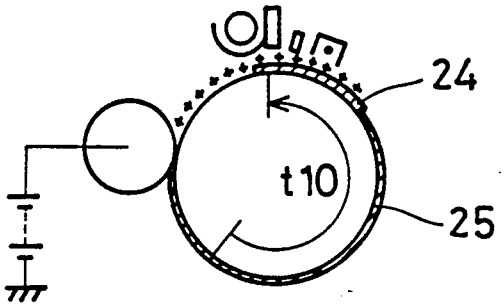
Figure 12C:
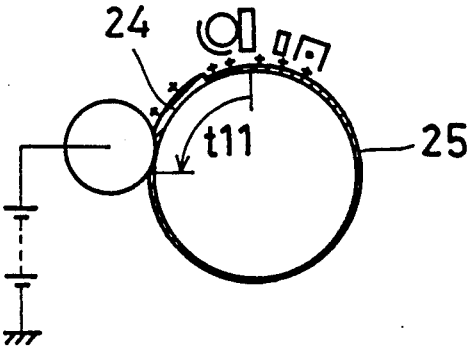

The process is explained referring to the flowchart of FIG. 11 and the timing chart of FIGS. 12A-12C. This process is also executed before the actual copying operation (or during the warming-up period).

In the process, first the motor and the main charger 2 are turned on, and the developing roller 15 is started and given the bias voltage at its minimum value (e.g., 100 V) at step #81. The CPU 9 waits for t8 seconds at step #82 so that the part of the drum 1 charged by the main charger 2 comes to the exposure section 4. Then the CPU 9 inputs the surface voltage E1 at step #83. Here, the detected part of the drum 1 does not wear toner powder yet. The CPU 9 again waits for t9 seconds at step #84, and then raise the bias voltage of the developing roller 15 to its maximum value (e.g., 500 V) at step #85. This time, as shown in FIG. 12A, the preceding part 23 of the drum 1 wears the thickest toner layer 24 because the bias there has been minimum (it should be remembered that powder is attracted to the drum 1 by the electrostatic force caused by the voltage difference between the drum 1 and the developing roller 15). After the bias is raised to the maximum value, the toner layer 25 becomes thinnest as shown in FIg. 12B.

The CPU 9 further waits for t10 seconds at step #86, and inputs the surface voltage value E2 of the drum 1 wearing the thickest toner layer 24 at step #87 (FIG. 12B). Since the thickest toner layer 24 is charged by the main charger 2 before the potential detection and the toner-powder layer can bear charge, the value E2 is normally high. Then the CPU 9 further waits for t11 seconds at step #88 before detecting the surface voltage E3 at the thinnest toner layer 25 at step #89 (FIG. 12C). According to the above explained reason, voltage E3 is normally lower than E2.

The sensed surface voltage values E1, E2 and E3 are compared at step #90 with respective normal ranges stored in the ROM 10. If any one of the voltages E1, E2 and E3 is out of the corresponding normal range, the abnormality processing for the developing roller biasing system is executed at step #93. If all the values E1, E2 and E3 are within the normal ranges, the relation between the three values E1, E2 and E3 are then checked at step #91. If they are not in the normal order (i.e., E1<E3<E2), abnormality step #93 is executed. If they are in the normal order, the motor, the main charger 2 and the developing roller 15 (including the biasing circuit) are turned off at step #92 to end the check process. After the abnormality processing of step #93, the test-finishing step #92 is executed.

Though the embodiments are specifically described for better understanding of the present invention, it is apparent for those skilled engineers in this field to modify them without departing from the scope of the following claimed invention. For example, the reference normal ranges I, II, etc. in the above embodiments may be stored in a random access memory (RAM) (not shown) to be changed according to the checking purpose. Further, the photoreceptor may be a belt-type instead of the drum as shown in FIG. 1. Of course, the invention is applicable to a printer using the photostatic image producing process.

What is claimed is:

1. A method for detecting an abnormality of a developing roller of a photostatic image-recording machine which includes a photoreceptor drum, a charging system for charging the photoreceptor drum, a developing roller for transferring toner power from the developing roller to the drum by a voltage difference between a bias voltage of the developing roller and a charger voltage of the photoreceptor drum, and a potentiometer means for controlling the charging voltage of the photoreceptor drum, the method comprising the steps of:

rotating the photoreceptor drum;

charging the photoreceptor drum using the charging system;

activating the developing roller with a bias voltage;

detecting the surface voltage of the photoreceptor drum using the potentiometer means when the part of the photoreceptor drum that has been charged by the charging system and has transferred the toner powder from the developing roller with the bias voltage comes to the potentiometer means;

comparing the detected surface voltage with a reference voltage range, the reference voltage range being a predetermined range for a normally operating charging system and developing roller; and judging that the developing roller is abnormal when the detected surface voltage is out of the reference voltage range;

wherein the surface voltage of the photoreceptor drum is detected three times, the first time being after the photoreceptor drum is charged by the charging system, the second time being after the photoreceptor drum has transferred the toner powder from the developing roller with the minimum value of the bias voltage, and the third time being after the photoreceptor drum has transferred the toner powder from the developing roller with the maximum value of the bias voltage;

a reference voltage range is predetermined for each of the three times; and the developing roller is judged abnormal when any one of the detected surface voltage values is out of the corresponding reference voltage range.

2. A method as in claim 1, where the developing roller is judged abnormal when magnitudes of the detected surface voltage values of the three times are not in a normal order.

3. An electrostatic image-recording machine for performing the method steps recited in claim 1, said machine including a memory storing a program embodying said steps, and a microcomputer working according to the program.

* * * * *